US006932886B2

(12) United States Patent
Wassermann et al.

(10) Patent No.: US 6,932,886 B2
(45) Date of Patent: Aug. 23, 2005

(54) MULTI-PLY FIBROUS PLASTERBOARD WEB

(75) Inventors: Alexander Wassermann, Vienna (AT); Manfred Feichtiger, St. Pölten (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/655,648

(22) Filed: Sep. 5, 2003

(65) Prior Publication Data

US 2004/0129396 A1 Jul. 8, 2004

Related U.S. Application Data

(63) Continuation-in-part of application No. 09/819,777, filed on Mar. 28, 2001, now abandoned.

(30) Foreign Application Priority Data

Mar. 30, 2000 (DE) ..... 100 15 828

(51) Int. Cl.[7] ..... D21H 27/38

(52) U.S. Cl. ..... 162/129; 162/130; 162/132; 162/133

(58) Field of Search ..... 162/129, 130, 162/132, 133, 304, 301, 303, 298, 299

(56) References Cited

U.S. PATENT DOCUMENTS

| | | | | |
|---|---|---|---|---|
| 5,445,713 A | * | 8/1995 | Kunihisa et al. | 162/304 |
| 5,607,555 A | | 3/1997 | Grossmann et al. | 162/304 |
| 6,159,341 A | | 12/2000 | Egelhof et al. | 162/303 |
| 6,267,846 B1 | | 7/2001 | Halmschlager et al. | 162/203 |
| 6,413,369 B2 | | 7/2002 | Kinnunen | 162/130 |

FOREIGN PATENT DOCUMENTS

| | | | |
|---|---|---|---|
| DE | 26 45 763 A1 | 4/1978 | D21F/9/04 |
| DE | 197 33 316 A1 | 2/1999 | B21F/1/00 |

OTHER PUBLICATIONS

Casey, Pulp and Paper,(1980) John Wiley & Sons, 3rd ed., vol. II, p978.*

* cited by examiner

*Primary Examiner*—Peter Chin
(74) *Attorney, Agent, or Firm*—Taylor & Aust, P.C.

(57) ABSTRACT

A fibrous web including a back liner having a higher fines side with a higher fines content, a top liner having a higher fines side with a higher fines content and at least one middle layer having a higher fines side with a higher fines content, and a lower fines side with a lower fines content, at least one middle layer and the top liner being couched together, the back liner having the higher fines side in contact with the lower fines side of at least one middle layer.

9 Claims, 1 Drawing Sheet

MULTI-PLY FIBROUS PLASTERBOARD WEB

CROSS REFERENCE TO RELATED APPLICATIONS

This is a continuation-in-part of U.S. patent application Ser. No. 09/819,777, entitled "MACHINE FOR THE MANUFACTURE OF A FIBROUS PLASTERBOARD WEB" filed Mar. 28, 2001 now abandoned.

BACKGROUND OF THE INVENTION

1. Field of the Invention

The present invention relates to a multi-ply fibrous web, and, more particularly to a multi-ply fibrous web with a reduced adhesion border.

2. Description of the Related Art

Several different former combinations have been proposed for the manufacturing of plasterboard:

In a machine design including two gap formers, drainage in both gap formers is affected firstly on the top wire side and subsequently on the bottom wire side, resulting in a higher fines content on the bottom wire side. A back liner top side, with a lower fines content, is couched together with the top liner bottom side, which has a higher fines content.

In a machine design including several cylinder mold formers, a concentration of fines is produced on the cylinder wire side. The top sides, which have a low fines content, are couched together with the wire sides which have a high fines content.

In a machine design having two machine wire webs for the top liner and the back liner, respectively, together with a so-called BelLiner gap former for middle layers, a concentration of fines on the top side is produced with the machine wire webs, and a concentration of fines on the bottom wire side is produced with the BelLiner gap former. The sides of high fines content of the top liner and a first middle layer are couched together and the side of low fines content of the first middle layer is couched with a low fines side of a second middle layer and/or the back liner.

In a machine design including a combination of several machine wire webs, a concentration of fines is produced on the top side during the machine wire drainage process. The top liner and the middle layers are couched together with their top sides of high fines content and the bottom facing wire sides of low fines content. The middle layer and the back liner are couched together with their top sides of high fines content facing each other.

In a machine design for the packaging industry having two gap formers, a so-called "DuoFormer Base" (PB10656) and a so-called "DuoFormer Top" (PB10449) with the same web running direction are provided in the sheet-forming process. In this case, the top wire side of low fines content is couched together with the bottom wire side of high fines content.

A disadvantage of the above machines lies in the fact that purposeful separation of the back liner and middle layer is not possible.

SUMMARY OF THE INVENTION

The present invention provides a machine for the manufacture of a fibrous web, particularly a plasterboard web, which allows a purposeful separation of the back liner and middle layer.

The present invention also provides a method of feeding the back liner and middle layer which are to be couched together into the relevant couching zone in such a way that the back liner side, with a higher fines content, comes into contact with the middle layer side, with a lower fines content.

The present invention additionally provides a fibrous web including a back liner having a higher fines side with a higher fines content, a top liner having a higher fines side with a higher fines content and at least one middle layer having a higher fines side with a higher fines content, and a lower fines side with a lower fines content, at least one middle layer and the top liner being couched together, the back liner having the higher fines side in contact with the lower fines side of at least one middle layer.

This development results in reduced adhesion between the middle layer and the back liner, allowing the purposeful separation of the back liner without causing the destruction of the top liner and the middle layer. A further advantage is achieved with regard to a possible alteration of the properties of the paper in terms of porosity, roughness, penetrative and printing characteristics.

For practical purposes, a Fourdrinier former is provided to produce the back liner, in which the sheet-forming process for the back liner is effected with a higher fines content on the top side facing away from the Fourdrinier wire web.

Ideally, the middle layer is produced by a gap former containing a forming element in which the sheet-forming process for the middle layer is effected with a higher fines content on the side of the forming element. The forming element used is preferably a forming roll.

In a preferred embodiment the jet direction of the headbox assigned to the middle layer former is set against the jet direction of the headbox assigned to the back liner former.

In an expedient and practical embodiment of the machine in accordance with this invention, the middle layer is reversed by a couch roll provided in the area of the respective couching zone.

By preference, the back liner top side with a higher fines content is couched together with the top wire side of the middle layer with a lower fines content.

It may be advantageous for the machine to be provided with a Fourdrinier former to produce the top liner, in which the sheet-forming process for the top liner is effected with a higher fines content on the top side facing away from the Fourdrinier wire web.

In an expedient and practical embodiment of the machine, the top liner which is to be couched with the middle layer is reversed on a couch roll provided in the area of the respective couching zone.

It may also be advantageous for the top side of the top liner with a higher fines content to be couched together with the bottom wire side of the middle layer with a higher fines content.

The gap former may be provided with either a single-layer or a multi-layer headbox.

Where required, constant pressure drainage elements can be provided for web drainage purposes. These may be used in combination with any of the formers. An example describing how they may be implemented can be found in document DE 197 33 316 A1.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Figure 1:
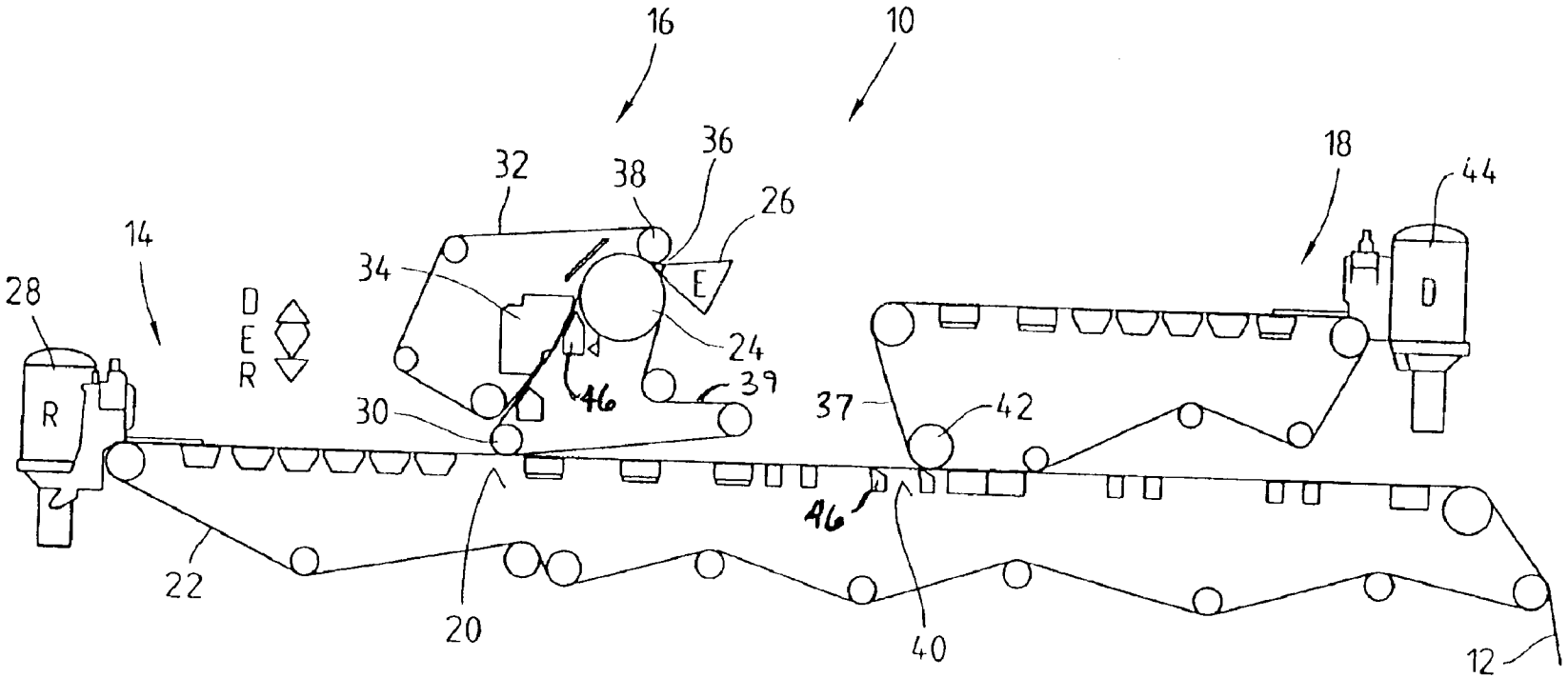
FIG. 1 is a schematic illustration of a machine for the manufacture of a fibrous plasterboard web of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawings, and more particularly to FIG. 1, there is shown a schematic drawing of a machine 10 for the manufacture of a fibrous web 12, in particular a plasterboard web, including back liner R, top liner D and at least one middle layer E positioned therebetween.

Back liner R is produced by Fourdrinier former 14, middle layer E is produced by gap former 16 and top liner D is produced by Fourdrinier former 18. In each case, sheet-forming is effected in such a way as to produce a higher fines content on one side of the respective layer than on the opposite side.

Back liner R and middle layer E, which are to be couched together, are fed into respective couching zone 20 in such a way that the side of back liner R, which has a higher fines content, comes into contact with the side of middle layer E which has a lower fines content.

Sheet-forming of back liner R in Fourdrinier former 14 is effected with a higher fines content on the top side facing away from Fourdrinier wire web 22.

Gap former 16 containing forming element 24 for the sheet-forming of middle layer E which is effected with a higher fines content on the forming element side. Forming element 24 is preferably a forming roll.

The jet direction of headbox 26 assigned to gap former 16 is generally set against the jet direction of headbox 28 assigned to Fourdrinier former 14.

Middle layer E is formed between top wire 32 and inner wire 39, then it is reversed on couch roll 30 in couching zone 20.

In the above case, the top side, with a higher fines content, of back liner R is couched together with the top wire side, with a lower fines content, of middle layer E.

Forming shoe 34 can be provided within the loop of top wire 32 in gap former 16.

Top wire 32 is guided over breast roll 38 in the area of fiber mixture wire gap 36. Headbox 26, loaded with fiber pulp slurry, feeds the fiber pulp slurry into fiber mixture wire gap 36.

Sheet-forming of top liner D in Fourdrinier former 18 is effected with higher fines content on the top side facing away from Fourdrinier wire web 22.

A top liner is formed on wire 37 and is herein known as top liner D. Top liner D, which is to be couched with middle layer E, is reversed on couch roll 42 in couching zone 40.

In the above case, the top side, with higher fines content, of top liner D is thus couched together with the bottom wire side, with higher fines content, of middle layer E.

The resulting distribution of fines is depicted in symbol form in the left-hand section of FIG. 1. The construction of the web allows for defined ply separation. The web includes at least three plies that are formed independently of each other. The combination of the plies permits a predetermined location for ply separation. The high specific surface area of fiber fragment fines contributes to superior bonding between layers when surfaces that abound in the fines are brought together in an operation, such as couching in a couching zone. When two plies having a low dry content are pressed together, fines are at least partially transported across the border, thereby improving the bonding strength between the plies. Two plies that have a high fines content along each side of a common boundary have a higher internal bonding strength as compared to one ply having a high fines content and one ply having a low fines content on respective sides of a common boundary. It is this situation, of one ply having a high fines content and one ply having a low fines content along a common boundary, that leads to a reduced adhesion border, which thereby allows for a separation of plies.

In the present invention the high fines side of back liner R is couched with the low fines side of a middle layer E, and the high fines side of top liner D is couched with the high fines side of middle layer E. This arrangement produces a multi-layer web with a reduced adhesion border that allows for the controlled separation between back liner R and middle layer E, while preserving the bond between top liner D and middle layer E, which has a high fines surface on each side of a common boundary. The separation of back liner R and middle layer E is accomplished without damage to top liner D and middle layer E.

Gap former 16 may be provided with a single-layer or multi-layer headbox 26.

The jet direction of headbox 44 assigned to Fourdrinier former 18 is generally set against the running direction of Fourdrinier wire web 22, through which layers R, E (which are already couched together) are fed into second couching zone 40.

Where required, constant pressure drainage elements 46 can be provided for purposes of web drainage. These may be used in combination with any of the formers.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fibrous web, comprising:

a back liner having a higher fines side with a higher fines content;

a top liner having a higher fines side with a higher fines content; and at least one middle layer having a higher fines side with a higher fines content, and a lower fines side with a lower fines content, at least one said middle layer and said top liner being couched together, said back liner having said higher fines side in contact with said lower fines side of at least one said middle layer, said higher fines side of said back liner that is in contact with said lower fines side of said at least one said middle layer forming a reduced adhesion layer allowing for complete separation between said back liner and said at least one middle layer.

2. The fibrous web of claim 1, wherein said separation is without damage to said top liner and said at least one middle layer.

3. The fibrous web of claim 1, wherein said back liner is formed on a Fourdrinier former having a first machine wire web, said first machine wire web conveying said back liner with said higher fines side of said back liner facing away from said first machine wire web.

4. The fibrous web of claim 3, wherein said at least one middle layer is formed in a gap former having a forming roll, said higher fines side of said at least one middle layer thereof facing said forming roll.

5. The fibrous web of claim 4, wherein said at least one middle layer is redirected as it is couched with said back liner.

6. The fibrous web of claim 4, wherein said higher fines side of said back liner is couched together with said lower fines side of said at least one middle layer by a couching roll associated with said gap former.

7. The fibrous web of claim 4, wherein said top liner is formed on a Fourdrinier former having a second machine wire web, said second machine wire web conveying said top liner with said higher fines side of said top liner facing away from said second machine wire web.

8. The fibrous web of claim 7, wherein said Fourdrinier former associated with said top liner includes a couch roll that redirects the flow of said top liner.

9. The fibrous web of claim 7, wherein said higher fines side of said top liner is couched together with said higher fines side of said at least one middle layer.

* * * * *